United States Patent [19]

Bühring et al.

[11] 4,323,718

[45] Apr. 6, 1982

[54] ARC FURNACE ROOF

[75] Inventors: Otto Bühring, Hürth, Fed. Rep. of Germany; Gerardus J. W. Dreessen, Vlissingen; Jacob W. H. Groeneveld, Middelburg, both of Netherlands; Robert Queck, Hürth; Heinrich Thome, Kerpen-Türnich, both of Fed. Rep. of Germany; Gerrit J. Willemsen, Middelburg, Netherlands

[73] Assignee: Hoechst Aktiengesellschaft, Frankfurt am Main, Fed. Rep. of Germany

[21] Appl. No.: 160,167

[22] Filed: Jun. 17, 1980

[30] Foreign Application Priority Data

Jun. 23, 1979 [DE] Fed. Rep. of Germany ..... 2925395

[51] Int. Cl.[3] ..... F27D 1/02; F27D 1/10

[52] U.S. Cl. ..... 373/73; 110/331; 501/124

[58] Field of Search ..... 13/35; 110/331, 335, 110/339, 336; 501/124

[56] References Cited

U.S. PATENT DOCUMENTS

| | | | |
|---|---|---|---|
| 1,978,077 | 10/1934 | Doyle et al. | 110/336 X |
| 3,429,973 | 2/1969 | Carter et al. | 110/331 X |
| 3,624,733 | 11/1971 | Eadie | 110/335 |

*Primary Examiner*—Roy N. Envall, Jr.
*Attorney, Agent, or Firm*—Connolly and Hutz

[57] ABSTRACT

The invention relates to an arc furnace roof. The roof is comprised of a metal cover which is bolt-connected to the furnace shell. Secured to the lower side of the cover is a plurality of shackle hooks, each of said shackle hooks having an anchor bolt hooked therein. The metal cover has a first layer of insulating concrete applied to its lower side and a second layer of refractory concrete applied to the hard first layer of insulating concrete, the two layers of insulating and refractory concrete, respectively, embedding the shackle hooks and anchor bolts.

10 Claims, 3 Drawing Figures

ARC FURNACE ROOF

Figure 1:
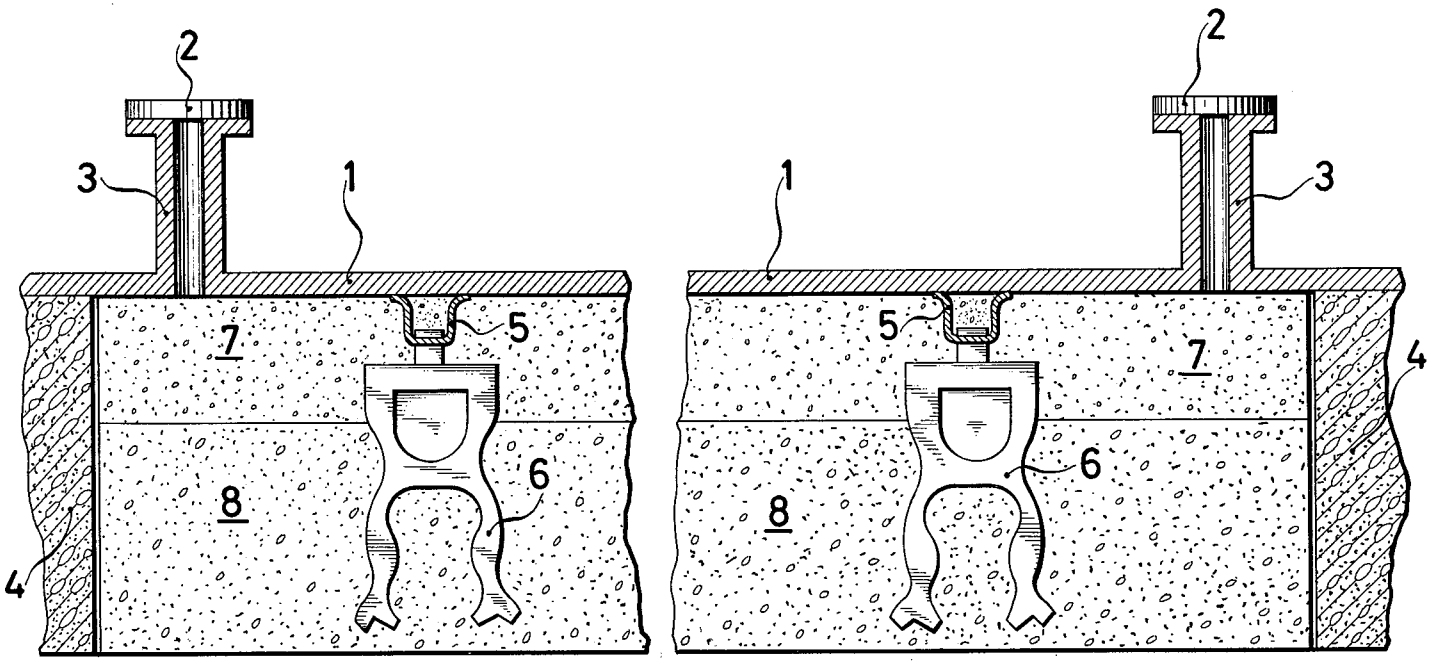

This invention relates to a roof for an arc furnace, more particularly for an electrothermal reduction furnace, the roof comprising a metal cover which is bolt-connected to the furnace shell and which has a layer of temperature-resistant ceramic material applied to its lower side.

An electrothermal reduction furnace for the production of phosphorus has been described of which the roof made from temperature-resistant alumina melt cement terminates upwardly in an antimagnetic steel cover which is bolt-connected to the furance shell. Additionally secured to the cover's lower side are cooling coils in which water is maintained under circulation to avoid exposure of the cover to excessively high temperatures or temperature variations (cf. WINNACKER-KÜCHLER: "Chemische Technologie", vol. 1, Anorganishce Technologie I, München 1970, page 386).

In order to avoid exposure of the metal cover to temperatures higher than 100° C., it is necessary for the cooling coils inside which water is maintained under circulation to be embedded in the layer of alumina melt cement. This is, however, not fully satisfactory. In the event of the cooling water circulation being disorganized for a short while only, high temperatures are liable to occur and fatally to affect the metallic coils which are embedded in the alumina melt cement. For repair, which is not easy to carry out, it is necessary to discontinue operation of the furnace for some prolonged time. Operation of the furnace with defective cooling coils is problematic inasmuch as water or steam may then find its way into the furnace which is highly undesirable.

It is therefore an object of the present invention to provide a furance roof which is left free from cooling water circulation coils but ensures exposure of the metal cover to temperatures not higher than 100° C.

To this end, the invention provides for the roof to comprise a metal cover with a plurality of shackle hooks being secured to the lower side thereof, each of said shackle hooks having an anchor bolt hooked therein; the metal cover being bolt-connected to the furnace shell, having a first layer of insulating concrete applied to its lower side and a second layer of refractory concrete applied to the hard first layer of insulating concrete; the said two layers of insulating concrete and refractory concrete, respectively, having the shackle hooks and anchor bolts embedded therein.

Further preferred features of the present invention provide:

(a) for 10 to 16 shackle hooks to be provided per $m^2$ of metal cover;

(b) for the shackle hooks to be regularly distributed across the entire surface area of the metal cover;

(c) for the anchor bolts to comprise ceramic bolts;

(d) for the anchor bolts to comprise metallic bolts, preferably cast iron bolts;

(e) for the layer of insulating concrete to be applied to the metal cover with the use of a hydraulically setting composition of 6 to 10 weight% $Al_2O_3$, 32 to 38 weight% $SiO_2$, 15 to 20 weight% MgO, 30 to 35 weight% CaO, and 40 to 200 weight% mixing water;

(f) for the metal cover to have the layer of insulating concrete cast thereonto;

(g) for the metal cover to have the layer of insulating concrete sprayed thereonto;

(h) for the layer of refractory concrete to be applied with the use of a hydraulically setting composition of 50 to 85 weight% $Al_2O_3$, 5 to 8 weight% $SiO_2$, and 10 to 20 weight% mixing water;

(i) for the metal cover to have the layer of refractory concrete cast thereonto; and (k) for the metal cover to have the layer of refractory concrete sprayed thereonto.

The furnace roof of this invention is a suspended roof which is considerably easier to produce and to repair than prior art roofs. In producing the roof of this invention it is possible for the furnace cover which may be comprised of a plurality of segments, for example, to be stored with its lower side directed upwards, and for the two layers of insulating and refractory concrete, respectively, to be applied thereto by a casting method. For repair, defective areas are sand-blasted, substitute anchor bolts are secured to the lower side of the furnace roof, and the layers of insulating and refractory concrete, respectively, are applied thereto by spraying from below, the layer of refractory concrete being applied several times, if necessary or convenient.

At temperatures within the range 600° to 900° C. prevailing at the lower side of the layer of refractory concrete, the metal cover forming part of the furnace roof of this invention is exposed to temperatures within the range about 75° to 90° C.

Figure 2:
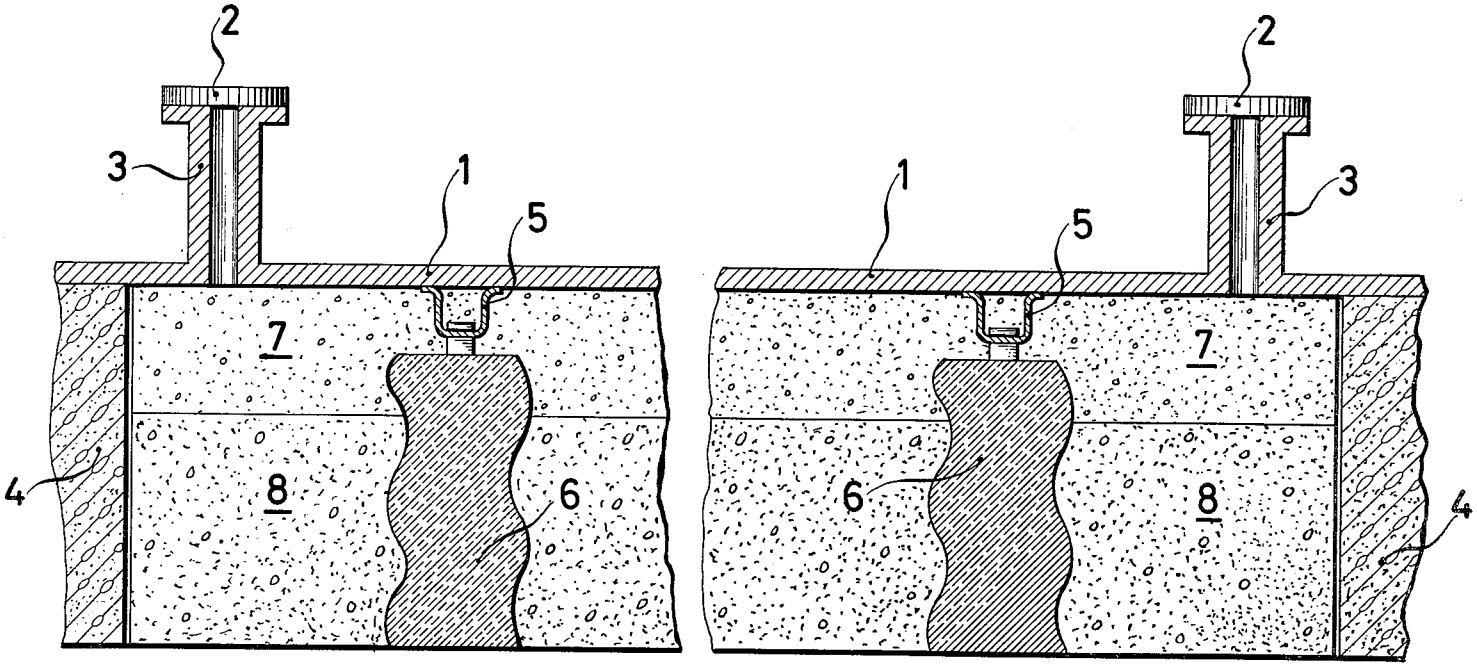
Figure 3:
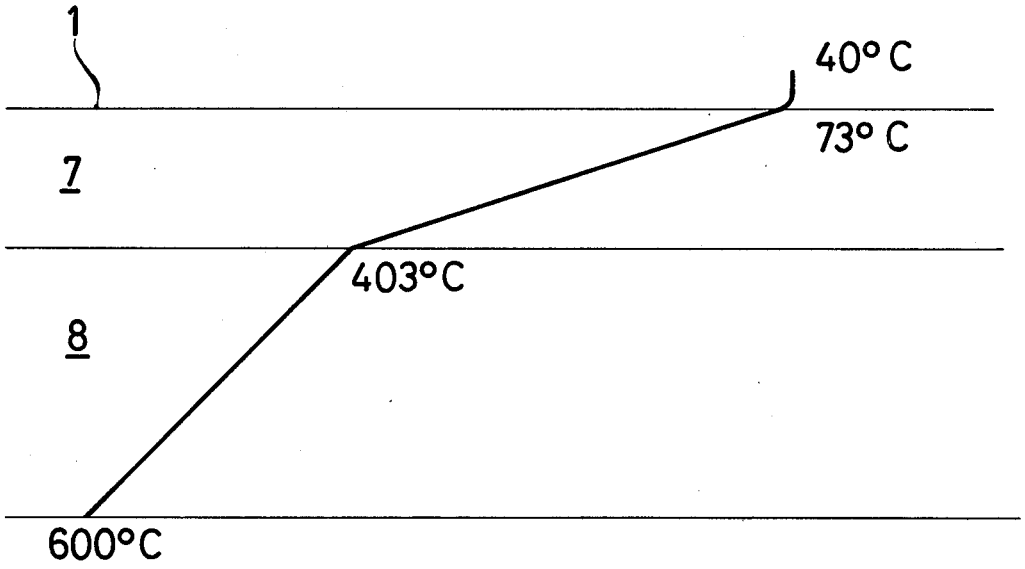

The invention will now be described with reference to the accompanying drawings. Exemplifying embodiments are shown diagrammatically, partially in section. More particularly, FIG. 1 represents a side elevational view of a furnace roof provided with cast iron anchor bolts;

FIG. 2 represents a side elevational view of a furnace roof provided with anchor bolts of ceramic material, and FIG. 3 represents the temperature gradient diagram determined for the furnace roof of FIG. 2.

With reference to the drawings:

A steel cover 1 of an arc furnace has electrodes, feed pipes and gas outlets passed through it. Via a ring holder 2, the cover 1 bears against a flange 3 forming part of the furnace shell of which the upper portion is lined with firebricks 4. Fastened to the underside of the cover 1 is a plurality of shackle hooks 5 which are spaced apart from each other at small separations and of which each has an anchor bolt 6 hooked therein. Reference numeral 7 denotes a layer of insulating concrete which is applied first to the underside of the cover 1, and reference numeral 8 denotes a layer of refractory concrete which is applied to the hard layer of insulating concrete 7.

The two layers of insulating and refractory concrete, respectively embedding the shackle hooks and the anchor bolts.

EXAMPLE 1

The antimagnetic steel cover of an electrothermal carbide furnace was stired with its lower side directed upwards. Welded to the cover's inside, regularly distributed across its surface area, was a plurality of shackle hooks spaced apart from each other at separations of about 40 cm. Hooked in the shackle hooks were anchor bolts of cast iron (cf. FIG. 1) which were kept transversely with respect to the cover, by means of an auxiliary mechanism. Next, a hydraulically setting insulating composition (CASTABLE BLOC-MIX-G, a product of Fleischmann company, Frankfurt/Main, Federal Republic of Germany) was poured in the form of a layer 7.5 cm thick, in the cover. This layer was allowed to set over a period of 8 to 14 hours at 20° C.; next, a 17.5 cm thick layer of a hydraulically setting casting composition (RAPID BLOCK RG 158, a product of Fleischmann company, Frankfurt/Main, Federal Republic of Germany) was applied thereonto. This latter layer was exposed for about 24 hours to the action of hot air of about 70° to 80° C. When cold, it had the compressive strength necessary for it to be turned, to be transported to the furnace and to be mounted thereonto.

EXAMPLE 2

Welded to the lower side of the antimagnetic steel cover of an electrothermal phosphorus furnace was a plurality of shackle hooks, which were spaced apart from each other at separations of 30 cm. Hooked therein were ceramic anchor bolts which had a corrugated surface (cf. FIG. 2); the base surface area was 8×8 cm and the length 25 cm. Sprayed on to the lower side of the cover was a layer about 10 cm thick of high temperature-resistant insulating concrete (CASTABLE BLOC-MIX-G, a product of Fleischmann company, Frankfurt/Main, Federal Republic of Germany) (heat transfer coefficient $\lambda=0.84$ kj/ml° C.). The layer of insulating concrete was allowed to set and an about 18 cm thick layer of refractory concrete (FIXOPLANT 155; this is a registered Trade Mark of Fleischmann company, Frankfurt/Main, Federal Republic of Germany) was sprayed thereonto.

A temperature of 600° C. was measured at the underside of the layer of refractory concrete, and a temperature of 73° C. was determined for the steel cover of the furnace (cf. FIG. 3).

We claim:

1. A roof for an electrical reduction furnace comprising a metal cover connectible by bolting to a furnace shell, a first layer of insulating concrete on the inward surface of the metal cover and a second layer applied in effective contact with the inward surface of the first layer, shackle hooks attached to the cover inward surfaces and having anchor bolts hooked thereon, said hooks and bolts being embedded within said first and second layers, characterized by a temperature gradient being producible in the roof positioned on the furnace during furnace operation, and in the absence of a coolant within the cover, of not more than 100° C. at the shell from a temperature of at least 600° C. in the furnace, said layers having been prepared by flowing onto the inward cover surface a hydraulically setting composition of 6 to 10 weight % $Al_2O_3$, 32 to 38 weight % $SiO_2$, 15 to 20 weight % MgO, 30 to 35 weight % CaO, and 40 to 200 weight % mixing water and applying the composition to the hooks, and setting the hydraulic setting composition to form said first layer in the cover and around the hooks in said first layer, and applying by flowing onto said first layer and said hooks a second layer of a hydraulically setting composition of 50 to 85 weight % $Al_2O_3$, 5 to 8 weight % $SiO_2$, and 10 to 12 weight % mixing water and heating the second composition to set said composition to form said second layer and embed said hooks within said second layer.

2. A roof for an electrical reduction furnace as claimed in claim 1 wherein 10 to 16 shackle hooks are provided per $m^2$ of metal cover.

3. A roof for an electrical reduction furnace as claimed in claim 1 wherein the shackle hooks are regularly distributed across the entire surface area of the metal cover.

4. A roof for an electrical reduction furnace as claimed in claim 1 wherein the anchor bolts are ceramic bolts.

5. A roof for an electrical reduction furnace as claimed in claim 1 wherein the anchor bolts are metallic bolts.

6. A roof for an electrical reduction furnace as claimed in claim 5 wherein the anchor bolts are cast iron bolts.

7. A roof for an electrical reduction furnace as claimed in claim 1 wherein said first layer of insulating concrete is prepared by casting said hydraulic setting composition.

8. A roof for an electrical reduction furnace as claimed in claim 1 wherein said first layer if insulating concrete is prepared by spraying said hydraulic setting composition.

9. A roof for an electrical reduction furnace as claimed in claim 1 wherein said second layer of hydraulic setting composition is refractory and is prepared by casting said hydraulic setting composition.

10. A roof for an electrical reduction furnace as claimed in claim 1 wherein said second layer of hydraulic setting composition is refractory and is prepared by spraying said hydraulic setting composition.

* * * * *